United States Patent [19]

Zion

[11] Patent Number: 4,504,175

[45] Date of Patent: Mar. 12, 1985

[54] HOLLOW ROD AND METHOD OF MAKING AND USING

[75] Inventor: Earl M. Zion, Newark, Ohio

[73] Assignee: Owens-Corning Fiberglas Corporation, Toledo, Ohio

[21] Appl. No.: 534,270

[22] Filed: Sep. 22, 1983

Related U.S. Application Data

[63] Continuation of Ser. No. 290,036, Aug. 5, 1981.

[51] Int. Cl.[3] ..... E21D 20/02

[52] U.S. Cl. ..... 405/260; 405/259; 52/108

[58] Field of Search ..... 405/259, 260, 261; 52/108; 138/154, 157, 162, 163, 166, 167, 168; 29/429, 414, 421

[56] References Cited

U.S. PATENT DOCUMENTS

| | | | |
|---|---|---|---|
| 2,013,242 | 9/1935 | Johns | 138/128 X |
| 2,532,504 | 12/1950 | Lapsley | 29/429 UX |
| 2,799,368 | 7/1957 | Alter | 52/108 |
| 3,242,576 | 3/1966 | Wheeler | 52/108 X |
| 3,250,077 | 5/1966 | Ede | 405/156 |
| 3,456,449 | 7/1969 | Heil | 405/156 |
| 4,079,592 | 3/1978 | Eakin | 405/260 |
| 4,092,814 | 6/1978 | Kern | 52/730 |
| 4,166,508 | 9/1979 | Berg | 52/108 X |
| 4,386,485 | 6/1983 | Kramer | 52/108 |

*Primary Examiner*—Dennis L. Taylor

*Attorney, Agent, or Firm*—Ronald C. Hudgens; Greg Dziegielewski; Paul J. Rose

[57] ABSTRACT

A hollow reinforcing rod insertable into a bored hole is a mine roof and assembled just before insertion therein from a plurality of coiled reinforcing elements of pultruded glass filament reinforced thermoset resin, the rod being cut from the coils after insertion in the hole.

8 Claims, 8 Drawing Figures

HOLLOW ROD AND METHOD OF MAKING AND USING

This is a continuation of application Ser. No. 290,036, filed Aug. 5, 1981.

TECHNICAL FIELD

This invention relates generally to reinforcing means, and more particularly to a coilable form of reinforcing elements, the elements from several coils being assembled at the job site to form substantially rigid reinforcing rods particularly useful in stabilizing mine roofs and other tunnel or underground chamber roofs.

BACKGROUND ART

A conventional machine for installing mine roof bolts uses bolts of a fixed length and requires a considerable amount of head room. For a thick mineral vein which it is desired to mine in several passes of the mining equipment, the mine roof must be rebolted before each pass.

Pultruded continuous fiber reinforced plastic mine roof bolts are disclosed in U.S. Pat. Nos. 4,194,873 and 4,247,224.

DISCLOSURE OF INVENTION

In accordance with the invention, coilable reinforcing elements from several coils are assembled into an annular configuration by passage through a die block and into a previously drilled hole at the job site. Less head room is required than for fixed-length bolts. In thick mineral veins, deep holes may be filled with long lengths of the reinforcing material sufficient for several passes of the mining equipment. The reinforcing material is held in place by resin injected between the walls of the drilled hole and the reinforcing material.

BRIEF DESCRIPTION OF DRAWINGS

The invention is hereinafter described in greater detail with reference to the accompanying drawings in which.

BEST MODE OF CARRYING OUT INVENTION

Figure 1:
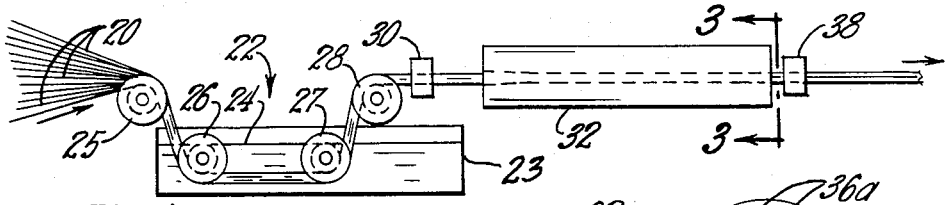
FIG. 1 is a schematic side elevational view of apparatus for producing the coilable reinforcing elements of the invention.
Figure 2:
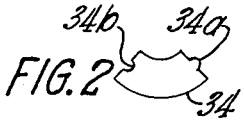
FIG. 2 is an end view of one of the coilable reinforcing elements of the invention.
Figure 3:
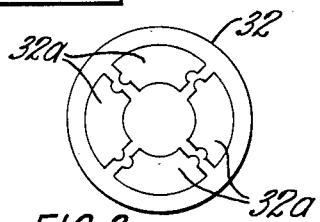
FIG. 3 is an end view, taken along the line 3—3 of FIG. 1, of a die for forming four ninety-degree coilable reinforcing elements of the invention simultaneously.
Figure 4:
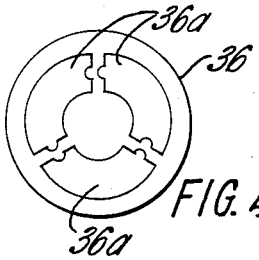
FIG. 4 is an end view of a die for forming three one-hundred-twenty-degree coilable reinforcing elements of the invention simultaneously.

With reference to the drawings, FIG. 1 shows a plurality of glass filaments 20 being fed from supply packages (not shown) through conventional resin impregnating apparatus 22 including a container 23 having hardenable liquid thermosetting resin 24 therein. The filaments are fed over an upper roller 25, under lower rollers 26 and 27, and over a second upper roller 28, and through a conventional wiper 30 which removes excess resin 24. The filaments 20, after being impregnated with resin 24, are drawn through a heated die 32 which cures the resin while forming the resin-impregnated filaments into rod-like reinforcing elements such as an element 34 shown in end view in FIG. 2. Preferably, the element 34 is generally arcuately shaped, subtends an angle of ninety degrees, and has a tongue **34*a* on a radial surface at one end and a groove 34*b* on a radial surface at an opposite end. The die 32 may be provided with a single aperture for making one reinforcing element 34 of indefinite length at a time. Alternatively, the die 32 may have four apertures 32*a* (FIG. 3) for making four reinforcing elements 34 simultaneously. In another alternative construction, shown in FIG. 4, a die 36 has three apertures 36*a*** for simultaneously producing three arcuate reinforcing elements each subtending an angle of one hundred twenty degrees.

Figure 5:
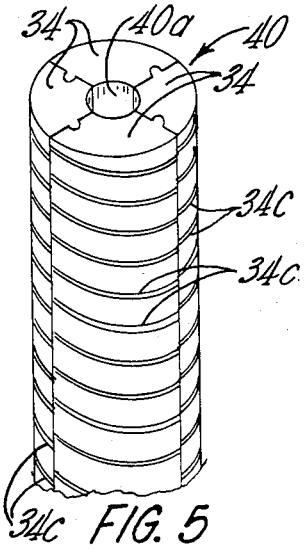
FIG. 5 is a fragmentary perspective view of four ninety-degree coilable reinforcing elements of the invention in assembled relationship for forming a substantially rigid reinforcing rod.

After leaving the heated die 32, the reinforcing elements 34 preferably pass through a rotating groove cutter 38. When the die 32 has four apertures **32*a*, the four resulting elements 34 are gathered by the cutter 38 into the shape of a hollow rod 40 such as shown in FIG. 5. Each element 34 is provided with a plurality of axially spaced angular grooves 34*c* on its outer circumferential surface. The grooves 34*c* are cut in the shape of a helix by the cutter 38, but in use of the rod 40, the elements 34 may harmlessly be axially displaced relative to each other so that the grooves 34*c* no longer form a helix. As hereinafter explained, the grooves 34*c* enhance bonding when the rod 40 is installed in a hole and surrounded with resin. After leaving the cutter 38, the elements 34** are separated and each is wound into a separate coil with the smallest windings about two feet in diameter. The coils may be on the same or separate spools.

Figure 6:
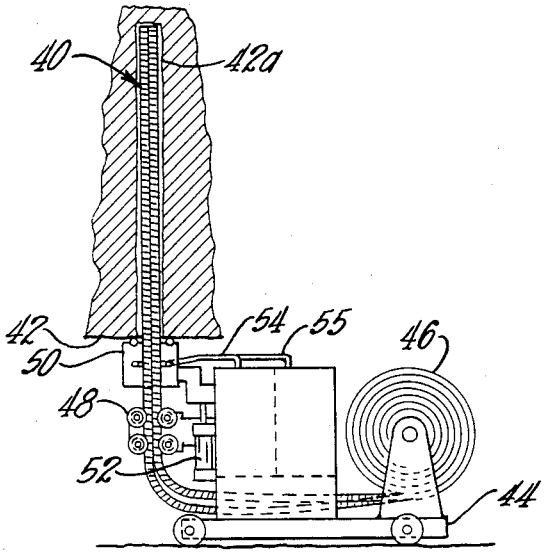
FIG. 6 is a schematic side elevational view, partly in section, of apparatus for installing reinforcing elements of the invention in a mine or other underground chamber roof.

FIG. 6 illustrates mine or other underground chamber roof 42 into which a hole **42*a* has been bored and schematically depicts a cart 44 carrying four coils 46, each of which supplies a reinforcing element 34 to a feeding mechanism 48. The feeding mechanism 48 drives a reinforcing rod 40 formed by the elements 34 through a resin injecting nozzle 50 and into the hole 42*a*. The nozzle 50 and a seal 51 are held in position against the mine roof 42 by a hydraulic actuator 52. Resin and curing agent tanks (not shown) on the cart 44 supply resin and a curing agent to the nozzle 50 through conduits 54 and 55** and pumping means (not shown).

Figure 7:
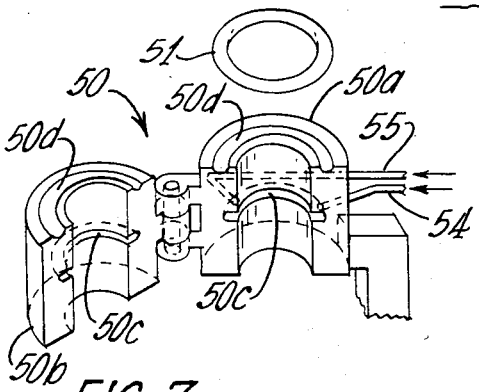
FIG. 7 is a schematic perspective view, partly in section, of a portion of the apparatus of FIG. 6.

The nozzle 50 and seal 51 are best shown in FIG. 7. The nozzle 50 includes pivotally interconnected halves **50*a* and 50*b* which, when closed, provide an annular mixing chamber 50*c* for the resin and curing agent supplied through conduits 54 and 55, and an annular groove 50*d* for the seal 51. The mixed resin is injected upwardly along the outside of the rod 40 formed by the reinforcing elements 34. The hollow center 40*a* (FIG. 5) of the rod 40 serves as a vent for air displaced by the mixed resin. After the resin mixture has hardened sufficiently, the nozzle 50 is removed and the rod 40 is cut off from the supply coils 46. If desired, the seal 51 may be split into two halves and the two halves permanently mounted respectively on the nozzle halves 50***a* and 50*b*. The hardened resin mixture forms a bond between the circular wall forming the hole 42*a* and the rod 40, and the strength of the bond is increased by the resin in the grooves 34*c*.

Figure 8:
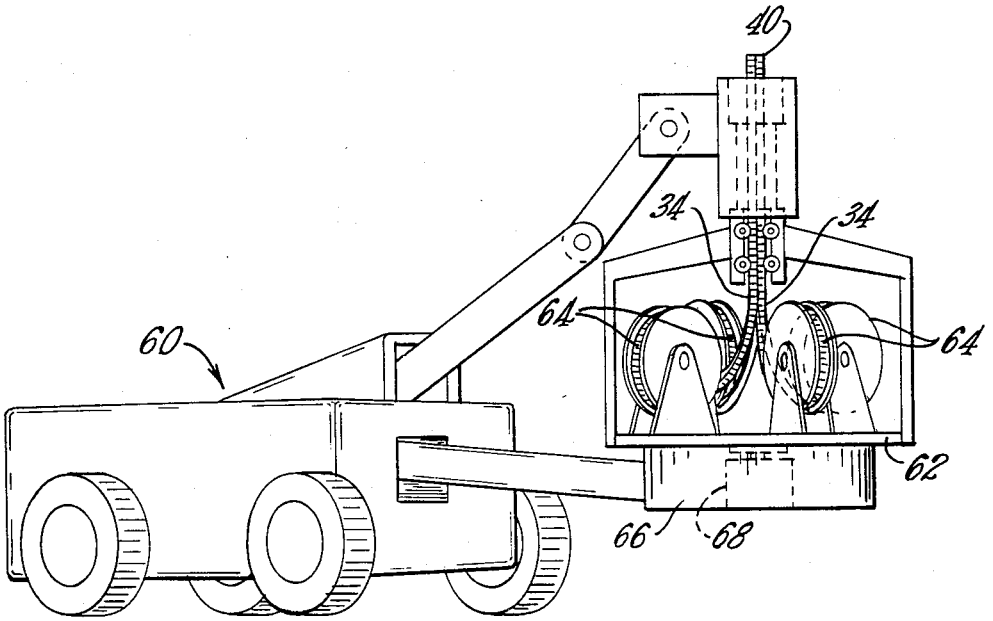
FIG. 8 is a schematic perspective view of alternative apparatus for installing reinforcing elements of the invention in a mine or other underground chamber roof.

The multi-sectioned rod 40 formed from coiled reinforcing elements 34 can also be used with a resin system wherein the resin and curing agent are packaged in separate compartments in a cartridge. FIG. 8 shows a machine 60 including a rotatable platform 62 having four coils 64 of reinforcing elements 34 mounted thereon for the forming of the hollow composite rod 40. The platform 62 is supported on a housing 66 and driven by a motor 68 therein. With a resin cartridge inserted in a hole such as the hole 42*a*, the rod 40 can be fed into the hole and rotated by rotation of the platform 62 to mix up the resin and curing agent of the cartridge after puncturing the cartridge.

The invention is not limited to the shape shown for the rod 40 or to the number and shape shown for the reinforcing elements 34. The invention lies in the structure and method of use of a plurality of coilable reinforcing elements which can be assembled into a reinforcing rod which could not be coiled if it were in one piece with respect to its cross section.

Various modifications may be made in the structure shown and described without departing from the spirit and scope of the invention.

I claim:

1. A method of reinforcing an underground chamber roof comprising boring a hole in the chamber roof, drawing a plurality of glass filament reinforced thermoset resin reinforcing rod elements respectively from coils thereof and progressively assembling them, at a locus upstream of and aligned with the entry to the bored hole, into a substantially rigid essentially non-coilable hollow reinforcing rod aligned as formed with the bored hole, inserting the reinforcing rod, hardenable liquid resin, and a curing agent into the bored hole, and cutting the reinforcing rod off from the coils of reinforcing rod elements.

2. A method as claimed in claim 1 wherein the reinforcing rod is inserted into the bored hole first and the resin and curing agent are then injected therearound.

3. A method as claimed in claim 1 wherein a cartridge of resin and curing agent is inserted into the bored hole first and the reinforcing rod is then inserted and rotated to rupture the cartridge and mix the resin and curing agent.

4. A method of reinforcing an underground chamber roof comprising boring a hole in the chamber roof, drawing a plurality of glass filament reinforced resin reinforcing rod elements, each having a cross-sectional shape which is the same for all cross-sections no matter where taken, respectively from coils thereof and progressively assembling them, at a locus upstream of and aligned with the entry to the bored hole, into a hollow reinforcing rod non-coilable into a coil having an inner diameter as small as that of any of the coils of the reinforcing rod elements and aligned as formed with the bored hole, inserting the reinforcing rod, hardenable liquid resin, and a curing agent into the bored hole, and cutting the reinforcing rod off from the coils of reinforcing rod elements.

5. A method of making a hollow rod at a site where the rod is to be used as a tensile member, the method comprising drawing a plurality of glass filament reinforced resin rod elements, each having a cross-sectional shape which is the same for all cross-sections no matter where taken, respectively from coils thereof shipped to the site, and progressively assembling them at the site, as they are drawn from the coils, into a hollow rod without changing the cross-sectional shape of any of the rod elements, whereby the cross-sectional shape of any of the rod elements is the same when the rod element is in the hollow rod as when it was in the respective coil, the hollow rod being non-coilable into a coil having an inner diameter as small as that of any of the coils of the rod elements.

6. A method as claimed in claim 5 wherein the rod elements are provided with cooperable tongue and groove portions for holding them together in the rod.

7. A hollow rod made up of a plurality of glass filament reinforced resin rod elements each flexible enough to have been wound separately into a coil, each rod element having an arcuate cross-sectional shape which is the same for all cross-sections no matter where taken and having a tongue portion on a radial surface at one end of the arcuate shape and a corresponding groove portion in a radial surface at an opposite end of the arcuate shape, the tongue and groove portions being cooperable to aid in interlocking the rod elements together, the cross-sectional shape of any of the rod elements being the same when the rod element is in the hollow rod as when it was in the respective coil, and the hollow rod being non-coilable into a coil having an inner diameter as small as that of any of the coils of the rod elements.

8. A hollow rod made up of a plurality of glass filament reinforced resin rod elements each flexible enough to have been wound separately into a coil, each rod element having an arcuate cross-sectional shape which is the same for all cross-sections no matter where taken, the cross-sectional shape of any of the rod elements being the same when the rod elements is in the hollow rod as when it was in the respective coil, and the hollow rod being non-coilable into a coil having an inner diameter as small as that of any of the coils of the rod elements.

* * * * *